US008857678B1

(12) United States Patent
Tseng et al.

(10) Patent No.: US 8,857,678 B1
(45) Date of Patent: Oct. 14, 2014

(54) HANGER FOR SUPPORTING GARMENT AND DEVICE FOR ENHANCING USE OF HANGER

(71) Applicants: Yi-Ming Tseng, Palo Alto, CA (US); Alexander [Yu-Deh] Tseng, Los Altos, CA (US); Ian [Yu-Hung] Tseng, Los Altos, CA (US)

(72) Inventors: Yi-Ming Tseng, Palo Alto, CA (US); Alexander [Yu-Deh] Tseng, Los Altos, CA (US); Ian [Yu-Hung] Tseng, Los Altos, CA (US)

( * ) Notice: Subject to any disclaimer, the term of this patent is extended or adjusted under 35 U.S.C. 154(b) by 17 days.

(21) Appl. No.: 13/904,045

(22) Filed: May 29, 2013

(51) Int. Cl.
*A47G 25/18* (2006.01)
*A47G 25/28* (2006.01)

(52) U.S. Cl.
CPC ..... *A47G 25/28* (2013.01)
USPC ..... 223/88

(58) Field of Classification Search
CPC ..... A47G 25/14; A47G 25/18; A47G 25/28; A47G 25/40; A47G 25/4015; A47G 25/44; A47G 25/441; A47G 25/443; A47G 25/442
USPC ..... 223/85, 88, 89, 92, 94, 95; D6/315, D6/319, 320, 325, 327; 211/113, 85.29, 211/85.3
See application file for complete search history.

(56) References Cited

U.S. PATENT DOCUMENTS

| | | | | | |
|---|---|---|---|---|---|
| 338,288 | A * | 3/1886 | Normandy | 211/102 |
| 1,052,426 | A * | 2/1913 | Ringler | 223/69 |
| 2,527,312 | A * | 10/1950 | Kenworthy | 223/89 |
| 2,926,822 | A * | 3/1960 | Anania | 223/89 |
| 2,987,193 | A * | 6/1961 | Pajor | 211/89.01 |
| 5,480,075 | A * | 1/1996 | Robinson | 223/88 |
| 5,645,200 | A * | 7/1997 | McDowell et al. | 223/89 |
| 6,425,490 | B1 * | 7/2002 | Ta | 211/116 |
| 6,964,360 | B2 * | 11/2005 | Tubman et al. | 223/85 |
| 8,028,869 | B2 * | 10/2011 | Rossaki | 223/94 |
| 8,631,979 | B1 * | 1/2014 | Reahard | 223/89 |
| 2004/0188475 | A1 | 9/2004 | Gouldson | |

* cited by examiner

*Primary Examiner* — Ismael Izaguirre

(57) ABSTRACT

A hanger may be used for supporting a garment. The hanger may include a hook, a medium connected to the hook, a first branch, a second branch, a third branch, and a fourth branch. The first branch may be connected through the medium to the hook and oriented according to a first direction. The second branch may be connected through the medium to the hook and oriented according to a second direction. The third branch may be coplanar with both the first branch and the hook, disposed between the first branch and the hook, connected to the medium, and oriented according to a third direction different from the first direction. The fourth branch may be connected to the medium and oriented according to a fourth direction different from the second direction, wherein the medium may be disposed between the third branch and the fourth branch.

20 Claims, 8 Drawing Sheets

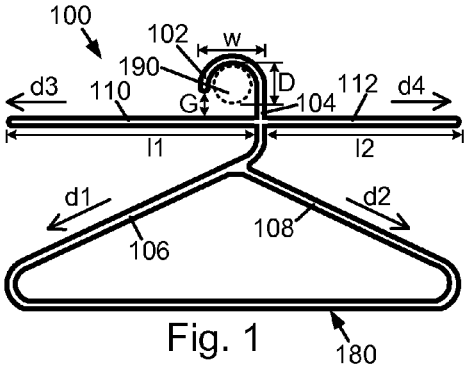
Fig. 1
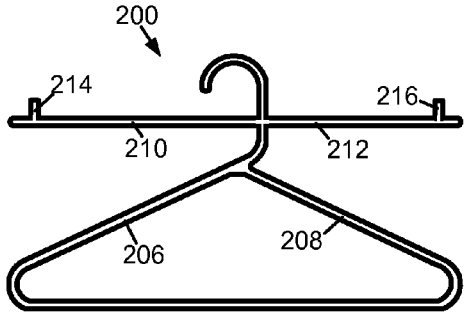
Fig. 2
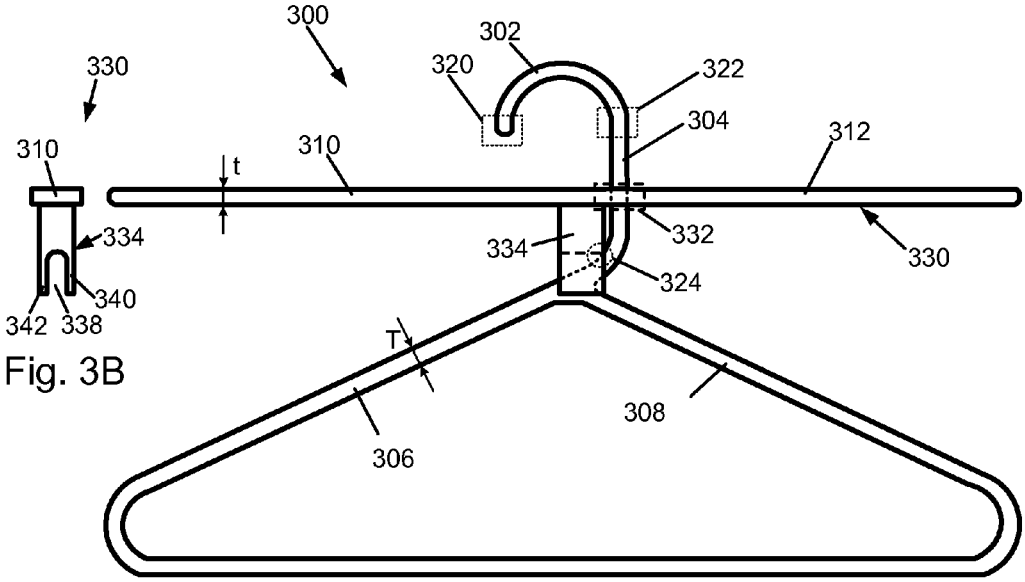
Fig. 3B
Fig. 3A
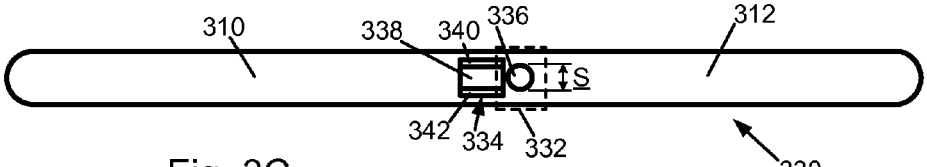
Fig. 3C
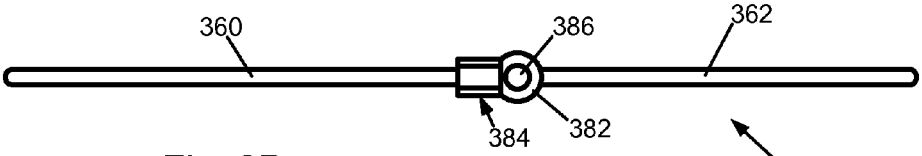
Fig. 3D

HANGER FOR SUPPORTING GARMENT AND DEVICE FOR ENHANCING USE OF HANGER

BACKGROUND OF THE INVENTION

The present invention is related to hangers for supporting garments and devices for enhancing the use of hangers.

Typically, a hanger may include hook to be hung on a rod and may include two branches connected to the hook for supporting a garment. The hanger may not enable utilization of the space above the branches.

SUMMARY

An embodiment of the present invention is related to a hanger for supporting at least a garment. The hanger may include a hook, a medium connected to the hook, a first branch, a second branch, a third branch, and a fourth branch. The first branch may be connected through the medium to the hook and oriented according to a first direction. The second branch may be connected through the medium to the hook and oriented according to a second direction. The third branch may be coplanar with both the first branch and the hook, disposed between the first branch and the hook, connected to the medium, and oriented according to a third direction different from the first direction. The fourth branch may be connected to the medium and oriented according to a fourth direction different from the second direction, wherein the medium may be disposed between the third branch and the fourth branch.

The above summary relates to only one of the many embodiments of the invention disclosed herein and is not intended to limit the scope of the invention, which is set forth in the claims herein. These and other features of the present invention will be described in more detail below in the detailed description of the invention and in conjunction with the following figures.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1 shows a schematic representation illustrating a view (e.g., a front view) of a hanger in accordance with one or more embodiments of the present invention.

FIG. 2 shows a schematic representation illustrating a view (e.g., a front view) of a hanger in accordance with one or more embodiments of the present invention.

FIG. 3A shows a schematic representation illustrating a view (e.g., a front view) of a hanger in accordance with one or more embodiments of the present invention.

FIG. 3B shows a schematic representation illustrating a view (e.g., a side view) of a device for enhancing use of a hanger in accordance with one or more embodiments of the present invention.

FIG. 3C shows a schematic representation illustrating a view (e.g., a bottom view) of a device for enhancing use of a hanger in accordance with one or more embodiments of the present invention.

FIG. 3D shows a schematic representation illustrating a view (e.g., a bottom view) of a device for enhancing use of a hanger in accordance with one or more embodiments of the present invention.

DETAILED DESCRIPTION

Figure 4A:
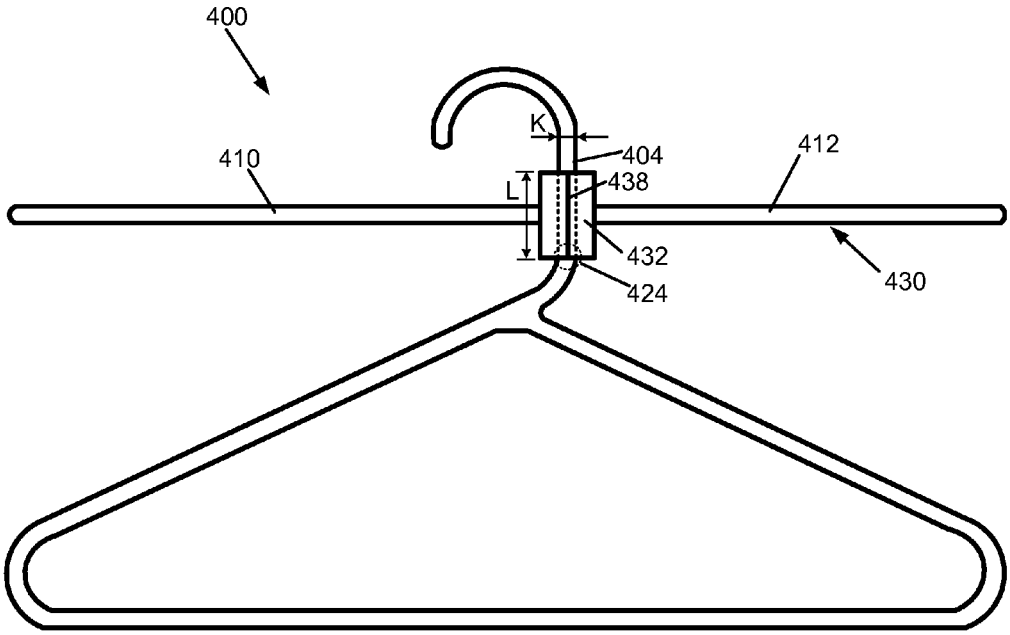
FIG. 4A shows a schematic representation illustrating a view (e.g., a front view) of a hanger in accordance with one or more embodiments of the present invention.

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps components, and/or structures may not have been described in detail in order to not unnecessarily obscure the present invention.

Although the terms first, second, etc. may be used herein to describe various signals, elements, components, regions, layers, and/or sections, these signals, elements, components, regions, layers, and/or sections should not be limited by these terms. These terms may be used to distinguish one signal, element, component, region, layer, or section from another signal, region, layer or section. Thus, a first signal, element, component, region, layer, or section discussed below may be termed a second signal, element, component, region, layer, or section without departing from the teachings of the present invention. The description of an element as a "first" element may not require or imply the presence of a second element or other elements. The terms first, second, etc. may also be used herein to differentiate different categories of elements. For conciseness, the terms first, second, etc. may represent first-type (or first-category), second-type (or second-category), etc., respectively.

One or more embodiments of the invention may be related to a hanger for supporting at least a garment. The hanger may include a hook, a medium connected to the hook, a first branch, a second branch, a third branch, and a fourth branch. The hook may include a curved and/or bent portion to be hung on a rod (e.g., a rod inside a closet or a rod of a rack). The medium may correspond to a neck portion of the garment. The first branch may be connected through the medium to the hook and may be oriented according to (or may extend or point in) a first direction. The second branch may be connected through the medium to the hook and may be oriented according to a second direction, wherein the second direction may be different from the first direction. The first branch and the second branch may correspond to two shoulder portions of the garment. The third branch may be coplanar with both the first branch and the hook, may be disposed between the first branch and the hook, may be connected to the medium, and may be oriented according to a third direction, wherein the third direction may be different from the first direction. The coplanar configuration may simply the manufacturing of the hanger and may minimize the footprint of the hanger. The fourth branch may be connected to the medium and may be oriented according to a fourth direction, wherein the fourth direction may be different from the second direction, and wherein the medium may be disposed between the third branch and the fourth branch. The third branch and the fourth branch may be used to support socks or gloves and may advantageously save space and time for storage and/or space for air-drying. The third branch and the fourth branch may also be used to support sleeves of a long-sleeve garment for air-drying. Advantageously, the overlap between the sleeves and the body portion of the garment may be reduced, and efficiency of the air-drying may be improved.

In one or more embodiments, the shape of the third branch (which may support a sock or a glove) may be substantially different from the shape of the first branch (which may support a shoulder portion of a garment). In one or more embodiments, the third branch may have one or more protrusions for retaining and/or expanding a clothing item or garment item (e.g., a sock, a mitten, a glove, or a sleeve). In one or embodiments, the third branch may include or may be attached to a y-shaped structure or a hand-shaped structure.

In one or more embodiments, the third branch may be horizontal or may point (or extend) upward when the first branch points (or extends) downward. The horizontal or upward orientation of the third branch may facilitate retention of a garment item.

In one or more embodiments, the third branch is not thicker than the first branch. The third branch may be made of the same material as the first branch. The third branch may not substantially add weight and may not substantially change hanger balance.

In one or more embodiments, a gap between the third branch and the hook may be less than or equal to 1.625 inches. Typically, the diameter of a closet rod or clothes rack rod may be in a range of 1.25 inches to 1.625 inches. The third branch and/or the hook may be made of a resilient material (e.g., plastic or steel) and may allow temporary enlargement of the gap to receive the rod. Subsequently, the rod may be substantially locked between the hook and the third branch, such that the hanger may not easily fall from the rod. In one or more embodiments, the gap may be less than or equal to 1.25 inch. In one or more embodiments, the gap may be less than 1.25 inch.

In one or more embodiments, the third branch may be asymmetric to the fourth branch with reference to the medium.

In one or more embodiments, a length of the third branch may be substantially equal to a sum of a length of the fourth branch and a width (e.g., an external diameter) of the hook.

In one or more embodiments, the span of the third branch and the fourth branch may be less than or equal to the span of the first branch and the second branch, such that the third branch and the fourth branch may not substantially increase the footprint of the hanger.

In one or more embodiments, the hanger may comprise a closed-loop structure that includes the first branch and the second branch and is coplanar with each of the hook, the third branch, and the fourth branch. The coplanar configuration may simply the manufacturing of the hanger and may minimize the footprint of the hanger.

In one or more embodiments, the third branch may form a first angle with the medium, the first angle being between the third branch and the hook and being less than 90 degrees.

In one or more embodiments, a distance between the third branch and the first branch may substantially monotonically decrease from a position corresponding to a middle of the third branch to the medium. For example, the first branch may extend downward for accommodating a shoulder portion of a garment, while the third branch may extend upward for retaining a sock.

In one or more embodiments, the hanger may include a first hollow portion, e.g., a first ring, surrounding the medium, wherein the first hollow portion may be connected to the third branch. A first module (or first device) including the first hollow portion and the third branch may be separated from or added to a second module (or second device) including the medium, the hook, and the first branch. The modular configuration may advantageously provide substantial flexibility.

In one or more embodiments, the hanger (or the first device) may include a stopper connected to at least one of the first hollow portion, the third branch, and the fourth branch. The stopper may have a recess, wherein at least one of a portion of the first branch and a portion of the second branch may be disposed inside the recess. The stopper may determine the gap between the third branch and the hook, may determine the distance between the third branch and the first branch, and may prevent the first device from rotating about the medium. Advantageously, the stability of the hanger may be maximized, and the footprint of the hanger may be minimized.

In one or more embodiments, the first hollow portion may be disposed between the third branch and the fourth branch.

In one or more embodiments, the first hollow portion may have a through hole and may have a gap for receiving the medium into the hole. The gap may not be substantially aligned with the third branch and/or the fourth branch. If the gap is aligned with the third branch or the fourth branch, the gap may be unintentionally opened when third branch or the fourth branch is loaded or weighed by a garment item. In one or more embodiments, the hole and the gap may extend parallel to the portion of the hanger that is surrounded by the ring, such as the medium.

In one or more embodiments, the gap may have a tapered structure for facilitating movement of a portion of the hanger (e.g., the medium) into the hole. A user may push the portion of the hanger through the gap into the hole, and the gap may subsequently close given the resilience of the ring.

In one or more embodiments, the third branch may be disposed at a second angle with respect to a top surface of the first hollow portion, wherein the second angle may be greater than 90 degrees and less than 180 degrees. The configuration may correspond to an upward orientation of the third branch, for effectively retain a garment item.

In one or more embodiments, a length of the ring is larger than or equal to a thickness (e.g., an external diameter) of the medium. According to the configuration, the ring may be stopped at a curved portion of the medium, for retaining at least one of the third branch and/or the fourth branch at a suitable position.

In one or more embodiments, the hanger may include a second hollow portion (e.g., a second ring) surrounding the medium. The second hollow portion may overlap (and may be stopped by) the first hollow portion. The second hollow portion may be connected to the fourth branch, wherein the third branch may be connected through the first hollow portion and the second hollow portion to the fourth branch.

In one or more embodiments, the hanger may include a ring surrounding the first branch. The hanger may further include a fifth branch connected through the ring to the first branch. The fifth branch may not be thicker than the first branch, such that the fifth branch may not substantially incur additional weight for the hanger (and the load for the rod). The fifth branch may be oriented according to a fifth direction. In one or more embodiments, the fifth direction may be different from the first direction. In one or more embodiments, the fifth direction may be the same as or parallel to the first direction. The fifth branch may further reduce an overlap of parts of the garment. Advantageously, efficiency of air-drying for the garment may be improved.

One or more embodiments of the invention may be related to a device for enhancing use of a hanger. The hanger may include a hook and may support a garment. The device may include a hollow portion having a through hole, the through being configured for receiving a portion of the hanger. The device may further include an elongated portion connected to the hollow portion, a thickness of the member being less than or equal to a width (e.g., an internal diameter) of the through hole.

One or more embodiments of the invention may be related to a device for enhancing use of a hanger. The hanger may include a hook to be hung on a rod and may support a garment. The device may include hollow portion (e.g., a ring) configured to surround a portion of the hanger, wherein the hollow portion may have a hole for receiving the portion of the hanger. The device may further include an elongated portion that is connected to the hollow portion. The elongated portion may be substantially longer than the hollow portion. A thickness (e.g., an external diameter) of the elongated portion may be less than or equal to an external width (e.g., an external diameter) of the hollow portion. In particular, the thickness of the elongated portion may be less than or equal to a width (e.g., the diameter) of the hole. The elongated portion may be thinner than or as thin as the portion of the hanger and other portions of the hanger. Therefore, the elongated portion may not add substantial weigh to the hanger and/or may not substantially change the balance of the hanger. The elongated portion may be used to support extra garment items, such as a sock or a portion of a sleeve of a long-sleeve garment, and/or may be used to reduce an overlap of parts of the garment, thereby improving efficiency of air-drying.

The features and advantages of the present invention may be better understood with reference to the figures and discussions that follow.

FIG. 1 shows a schematic representation illustrating a view (e.g., a front view) of a hanger 100 in accordance with one or more embodiments of the present invention. Hanger 100 may be used to support a garment. As illustrated in the example of FIG. 1, hanger 100 may include a hook 102, a medium 104 connected to hook 102, a first branch 106, a second branch 108, a third branch 110, and a fourth branch 112. Hook 102 may include a curved and/or bent portion to be hung on a rod 190 (e.g., a rod inside a closet or a rod of a rack). Medium 104 may correspond to a neck portion of the garment. Branch 106 may be connected through medium 104 to hook 102 and may be oriented according to (or may extend or point in) a first direction d1. Branch 108 may be connected through medium 104 to hook 102 and may be oriented according to a second direction d2. In one or more embodiments, direction d2 may be different from direction d1. Branch 106 and branch 108 may correspond to two shoulder portions of the garment. Branch 110 may be coplanar with both branch 106 and hook 102, may be disposed between branch 106 and hook 102, may be connected to medium 104, and may be oriented according to a third direction d3, wherein direction d3 may be different from direction d1. The coplanar configuration may simply the manufacturing of hanger 100 and may minimize the footprint of hanger 100. Branch 112 may be connected to medium 104 and may be oriented according to a fourth direction d4, wherein direction d4 may be different from direction d2, and wherein medium 104 may be disposed between branch 110 and branch 112.

Branch 110 and branch 112 may extend from opposite sides of medium 104. The span of branch 110 and branch 112 may be less than or equal to the span of branch 106 and the second branch, such that branch 110 and branch 112 may not substantially increase the footprint of hanger 100. Branch 110 and branch 112 may enable utilization of space above branch 106 and branch 108 without substantially increasing the footprint of hanger 100. Branch 110 and branch 112 may be used to support socks or gloves and may advantageously save space and time for storage and/or space for air-drying. Branch 110 and branch 112 may also save time for pairing socks and gloves. Branch 110 and branch 112 may also be used to support sleeves of a long-sleeve garment for air-drying. Advantageously, the overlap between the sleeves and the body portion of the garment may be reduced, and efficiency of the air-drying may be improved.

A gap G between branch 110 and hook 102 may be less than or equal to a thickness D (e.g., an external diameter) of a rod 190 to be used with hanger 110. Branch 110 and/or hook 102 may be made of a resilient material (e.g., plastic or steel) and may allow temporary enlargement of gap G to receive rod 190. Subsequently, rod 190 may be substantially locked between hook 102 and branch 110, such that hanger 100 may not easily fall from rod 190. Typically, the diameter of a closet rod or clothes rack rod may be in a range of 1.25 inches to 1.625 inches. In one or more embodiments, gap G may be less than or equal to 1.625 inches. In one or more embodiments, gap G may be less than or equal to 1.25 inch. In one or more embodiments, gap G may be less than 1.25 inch.

Branch 110 may be asymmetric to (e.g., longer than) branch 112 with reference to medium 104. In one or more embodiments, the length 11 of branch 110 may be substantially equal to the sum of the length 12 of branch 112 and a width w (e.g., an external diameter) of hook 102.

Hanger 100 may comprise a closed-loop structure 180 that includes branch 106 and branch 108 and is coplanar with each of hook 102, branch 110, and branch 112.

FIG. 2 shows a schematic representation illustrating a view (e.g., a front view) of a hanger 200 in accordance with one or more embodiments of the present invention. One or more features of hanger 200 may be identical to, equivalent to, corresponding to, or analogous to one or more features of hanger 100 discussed with reference to the example of FIG. 1. In hanger 200, the shape of branch 210 (which may support a sock or a glove) may be substantially different from the shape of branch 206 (which may support a shoulder portion of a garment); the shape of branch 212 (which may support a sock or a glove) may be substantially different from the shape of branch 208 (which may support a shoulder portion of a garment). Each of branch 210 and branch 212 may have one or more protrusions (e.g., one or more of protrusion 214 and protrusion 216) for retaining and/or expanding a clothing item or garment item (e.g., a sock, a mitten, a glove, or a sleeve) supported thereon. In one or embodiments, each of branch 210 and branch 212 may include a y-shaped structure or a hand-shaped structure. In one or embodiments, each of branch 210 and branch 212 may be attached to a y-shaped structure or a hand-shaped structure.

FIG. 3A shows a schematic representation illustrating a view (e.g., a front view) of a hanger 300 that includes a device 330 for enhancing use of hanger 300 in accordance with one or more embodiments of the present invention. FIG. 3B shows a schematic representation illustrating a view (e.g., a side view) of device 330 in accordance with one or more embodiments of the present invention. FIG. 3C shows a schematic representation illustrating a view (e.g., a bottom view) of device 330 in accordance with one or more embodiments of the present invention. One or more features of hanger 300 may be identical to, equivalent to, corresponding to, or analogous to one or more features of one or more of hangers 100 and 200 discussed with reference to the examples of FIGS. 1-2.

In hanger 300, branch 310 may be horizontal when branch 306 points (or extends) downward. The horizontal orientation of branch 310 may facilitate retention of a garment item.

A thickness t of branch 310 may be less than or equal to a thickness T of branch 306. Branch 310 may not be thicker than branch 308, for avoiding substantially adding weight or substantially changing hanger balance. Branch 310 may be made of the same material as branch 306.

Hanger 300 (or device 330) may include a hollow portion 332 surrounding medium 304. Hollow portion 332 may include a through hole 336 for receiving medium 304. Hollow portion 332 may be (directly) connected to branch 310 and branch 312 and may be disposed between branch 310 and branch 312. In one or more embodiments, hollow portion 332, branch 310, and branch 312 may represent three portions of an integral member of device 330. Device 330, which may include hollow portion 332, branch 310, and branch 312, may be separated from or added to a module that includes hook 302, medium 304, branch 306, and branch 308 and may be equivalent to a conventional hanger. The modular configuration may advantageously provide substantial flexibility. Device 330 may enhance use of preexisting, conventional hangers.

Hanger 300 (or device 330) may include a stopper 334 connected to at least one of hollow portion 332, branch 310, and branch 312. Stopper 334 may have a recess 338 positioned between a wall 340 and a wall 342, wherein at least one of a portion of branch 306 and a portion of branch 308 may be disposed inside recess 338. Stopper 334 may determine the gap between branch 310 and hook 302, may determine the distance between branch 310 and branch 306, and/or may prevent device 330 from rotating about medium 304. Advantageously, the stability of hanger 300 may be maximized, and the footprint of the hanger may be minimized.

A user may insert an end 320 of hook 302 through hole 336 of hollow portion 332, orienting device 330 such that branch 310 and branch 312 may not interfere with branch 306 and/or branch 308. The user may slide device 330 (or hollow portion 332) along hook 302 such that device (or hollow portion 332) passes a point 322 to medium 304, which may be substantially straight. Subsequently, the user may rotate device 330 such that recess 338 may be substantially aligned with branch 306 and/or branch 308. The user may continue to slide device 330 (or hollow portion 332) along medium 304 until stop stopper 334 (or a surface of recess 338) contacts branch 306 or branch 308 at a stop point 324 such that further translation of device 330 may be prevented. Wall 340 and/or wall 342 may engage branch 306 and/or branch 308 such that further rotation of device 330 may be prevented. As a result, hanger 330 may have a stable and/or robust structure.

A thickness t of branch 310, which may be less than or equal to a thickness of hollowed portion 332, may be less than or equal to a width S (e.g., an internal diameter) of hole 336, wherein the width S of hole 336 may substantially correspond to at least one a thickness of hook 302 and a thickness of medium 304. Branch 310 may have a minimized thickness for minimizing weight and/or minimizing material cost and may have a sufficient thickness and strength for supporting a garment item. Hollow portion 332 may be sufficient thin in order to slide along one or more curved portions of hook 302 (and medium 304).

FIG. 3D shows a schematic representation illustrating a view (e.g., a bottom view) of device 380 for enhancing use of a hanger in accordance with one or more embodiments of the present invention. One or more features of device 380 may be identical to, equivalent to, corresponding to, or analogous to one or more features of device 330 discussed with reference to the examples of FIGS. 3A-3C. Device 380 may include a ring 382 that has a through hole 386 and has one or more features analogous to one or more features associated with hollow portion 332 of device 330. Device 380 may include a stopper 384 that has one or more features analogous to one or more features associated with stopper 334 of device 330. Branch 360 and branch 362 of device 380 may be narrower than branch 310 and branch 312 of device 330, may have less weight, and/or may require lower material cost. On the other hand, device 330 may be associated with a simpler structure and/or lower manufacturing cost.

Figure 4B:
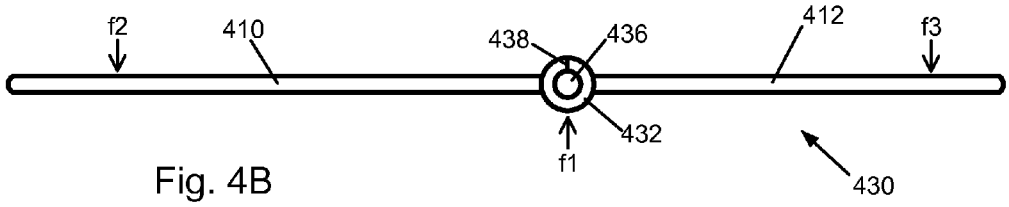
FIG. 4B shows a schematic representation illustrating a view (e.g., a bottom view) of a device for enhancing use of a hanger in accordance with one or more embodiments of the present invention.
Figure 4C:
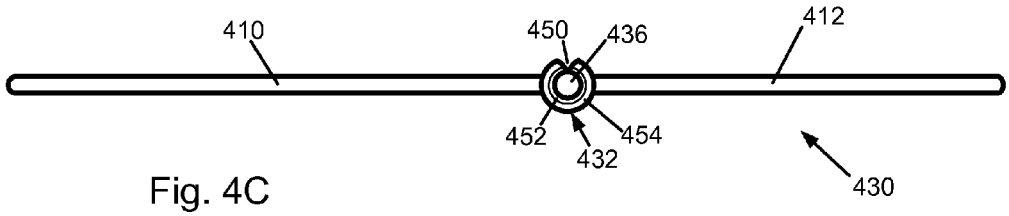
FIG. 4C shows a schematic representation illustrating a view (e.g., a bottom view) of a device for enhancing use of a hanger in accordance with one or more embodiments of the present invention.

FIG. 4A shows a schematic representation illustrating a view (e.g., a front view) of a hanger 400 that includes a device 440 for enhancing use of hanger 400 in accordance with one or more embodiments of the present invention. FIG. 4B shows a schematic representation illustrating a view (e.g., a bottom view) of device 440 in accordance with one or more embodiments of the present invention. FIG. 4C shows a schematic representation illustrating a view (e.g., a bottom view) of device 440 in accordance with one or more embodiments of the present invention. One or more features of hanger 400 may be identical to, equivalent to, corresponding to, or analogous to one or more features of one or more of hangers 100, 200, and 300 discussed with reference to the examples of FIGS. 1-3. One or more features of device 430 may be identical to, equivalent to, corresponding to, or analogous to one or more features of devices 330 and 380 discussed with reference to the examples of FIGS. 3A-3D.

In hanger 400 (or device 430), hollow portion 432 (connected between branch 410 and branch 412) may have a through hole 436 and may have a gap 438 for receiving a portion of hanger 400, e.g., medium 404, into hole 436. Hole 436 and gap 438 may extend substantially parallel to the portion of the hanger that is surrounded by hollow portion 432, e.g., medium 404.

Gap 438 may not be substantially aligned with branch 410 and/or branch 412. If gap 438 is aligned with branch 410 or branch 412, gap 438 may be unintentionally opened when branch 410 or branch 412 is loaded or weighed by a garment item.

A length L of hollow portion 432 may be larger than or equal to a thickness K (e.g., an external diameter) of medium 404. Hollow portion 432 (and therefore device 430) may be stopped at a curved portion of medium 404, such as stop point 424. Therefore, branch 410 and branch 412 may be retained at a suitable position and may support garment items in a stable manner.

In one or more embodiments, as illustrated in the example of FIG. 4B, hollow portion 432 may have a ring structure. Hollow portion 432 may be made of or may include a resilient material, such as plastic, steel, or stainless steel. A user may apply one or more of forces f1, f2, and f3 and/or provide support at one or more of hollow portion 432, branch 410, and branch 412 to open (or enlarge) gap 438, for receiving medium 404 into hole 436 or for removing medium 404 from hole 436.

In one or more embodiments, as illustrated in the example of FIG. 4C, gap 438 may have a tapered structure 450 for facilitating movement of a portion of the hanger (e.g., medium 404) into hole 436. A user may push the portion of the hanger through gap 438 into hole 436, and gap 438 may automatically close given the resilience of hollow portion 432. Friction between hollow portion 432 and medium 404 may minimize or prevent rotation of device 430 about medium 404.

In one or more embodiments, hollow portion 432 may include a resilience layer 454 and a friction layer 452 surrounded by resilience layer 454. Friction layer 452 may engage medium 404 and may minimize or prevent rotation of device 430 about medium 404.

Figure 5A:
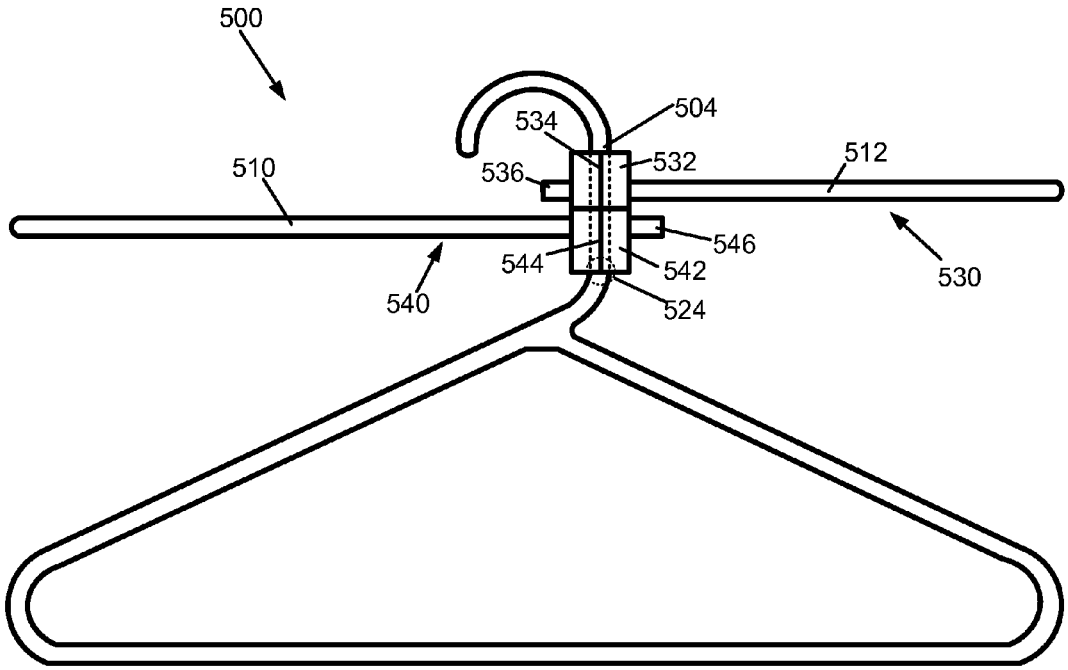
FIG. 5A shows a schematic representation illustrating a view (e.g., a front view) of a hanger in accordance with one or more embodiments of the present invention.
Figure 5B:
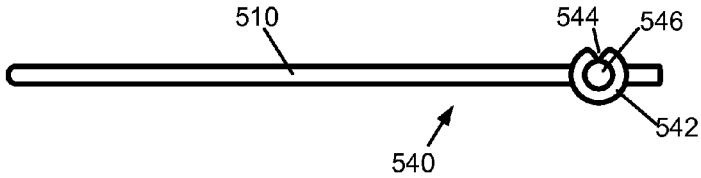
FIG. 5B shows a schematic representation illustrating a view (e.g., a bottom view) of a device for enhancing use of a hanger in accordance with one or more embodiments of the present invention.
Figure 5C:
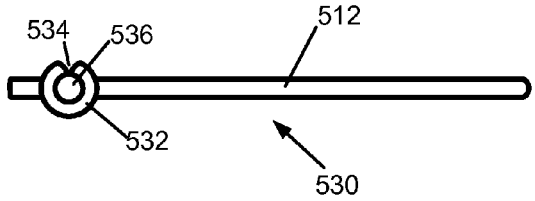
FIG. 5C shows a schematic representation illustrating a view (e.g., a bottom view) of a device for enhancing use of a hanger in accordance with one or more embodiments of the present invention.
Figure 5D:
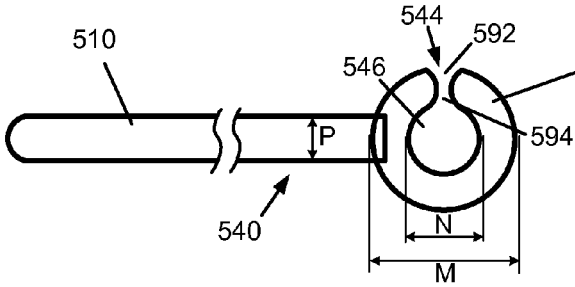
FIG. 5D shows a schematic representation illustrating a view (e.g., a bottom view) of a device for enhancing use of a hanger in accordance with one or more embodiments of the present invention.

FIG. 5A shows a schematic representation illustrating a view (e.g., a front view) of a hanger 500 that includes a device 540 and a device 530 for enhancing use of hanger 500 in accordance with one or more embodiments of the present invention. FIG. 5B shows a schematic representation illustrating a view (e.g., a bottom view) of device 540 in accordance with one or more embodiments of the present invention. FIG. 5C shows a schematic representation illustrating a view (e.g., a bottom view) of device 530 in accordance with one or more embodiments of the present invention. FIG. 5D shows a schematic representation illustrating a view (e.g., a bottom view) of device 540 in accordance with one or more embodiments of the present invention. One or more features of hanger 500 may be identical to, equivalent to, corresponding to, or analogous to one or more features of one or more of hangers 100, 200, 300, and 400 discussed with reference to the examples of FIGS. 1-4. One or more features of device 540 and device 530 may be identical to, equivalent to, corresponding to, or analogous to one or more features of devices 330, 380, and 430 discussed with reference to the examples of FIGS. 3A-4C.

Device 540 may include a branch 510 and a hollow portion 542 connected to each other. Hollow portion 542 may have a through hole 546 and may have a gap 544 for receiving a portion of hanger 500, e.g., a first portion of medium 504, into hole 436. In one or more embodiments, device 540 may include a force application unit 546 connected to hollow portion 542 and configured to receive a force or support from a user when a user intends to open gap 544. Hollow portion 542 may be disposed between branch 510 and force application unit 546.

Device 530 may include a branch 512 and a hollow portion 532 connected to each other. Hollow portion 532 may have a through hole 536 and may have a gap 544 for receiving a portion of hanger 500, e.g., a second portion of medium 504, into hole 436. In one or more embodiments, device 540 may include a force application unit 536 connected to hollow portion 532 and configured to receive a force or support from a user when a user intends to open gap 534. Hollow portion 532 may be disposed between branch 512 and force application unit 536.

Hollow portion 532 may overlap (and may be stopped by) hollow portion 542. Hollow portion 542 may be stopped at suitable stop point 524. Branch 510 may be connected through hollow portion 542 and hollow portion 532 to branch 512.

In one or more embodiments, as illustrated in the example of FIG. 5D, gap 544 may have a first tapered structure 592 for facilitating entry of medium 504 into hole 546 and may have a second tapered structure 594 for facilitating exit of medium 504 from hole 546. Gap 534 of device 530 and/or gap 438 of device 430 may analogously have two tapered structures.

In one or more embodiments, as illustrated in the example of FIG. 5D, a thickness P (e.g., an external diameter) of branch 510 may be less than or equal to an external width M (e.g., an external diameter) of hollow portion 542. In particular, thickness P of branch 510 may be less than or equal to a width N (e.g., an internal diameter) of hole 546. Branch 510 may be thinner than or as thin as medium 504 and other portions of hanger 500. Therefore, branch 510 may not add substantial weigh to hanger 500 and/or may not substantially change the balance of hanger 500.

Figure 6:
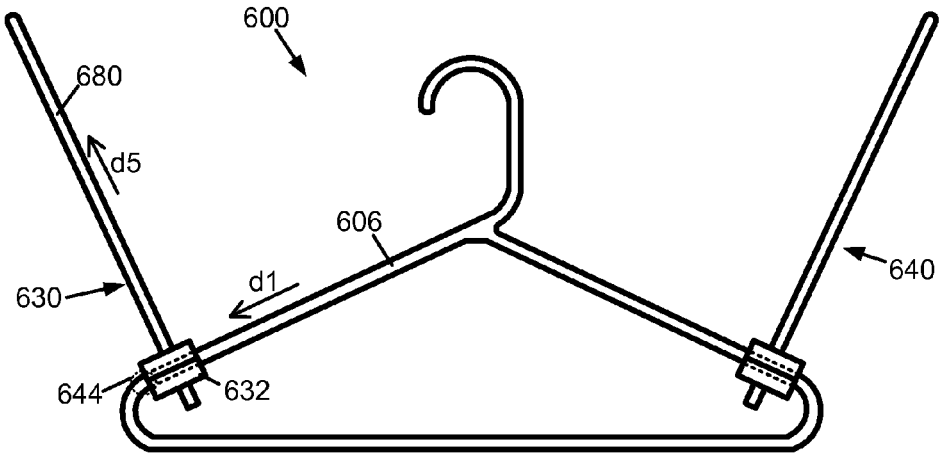
FIG. 6 shows a schematic representation illustrating a view (e.g., a front view) of a hanger in accordance with one or more embodiments of the present invention.

FIG. 6 shows a schematic representation illustrating a view (e.g., a front view) of a hanger 600 that includes a device 630 for enhancing use of hanger 600 in accordance with one or more embodiments of the present invention. One or more features of hanger 600 may be identical to, equivalent to, corresponding to, or analogous to one or more features of one or more of hangers 100, 200, 300, 400, and 500 discussed with reference to the examples of FIGS. 1-5. One or more features of device 630 may be identical to, equivalent to, corresponding to, or analogous to one or more features of devices 330, 380, 430, 540, and 530 discussed with reference to the examples of FIGS. 3A-5D.

Hanger 600 may include a branch 606 and device 630. Branch 606 may be configured to support a shoulder portion of the garment. Device 630 may include a hollow portion 632 (e.g., a ring) coupled with branch 606, surrounding a portion of branch 606, and stopped at a curved portion 644 of branch 606. Device 630 may further include a branch 680 connected through hollow portion 632 to branch 606. Branch 680 may not be thicker than branch 606, such that branch 680 may not substantially incur additional weight for hanger 600 (and the load for the rod on which hanger 600 is hung). Branch 680 may be oriented according to a direction d5, and branch 606 may be oriented according to a direction d1. In one or more embodiments, direction d5 may be different from direction d1. Branch 680 may reduce an overlap between parts of the garment, e.g., an overlap between a sleeve and a body portion of a shirt. Advantageously, efficiency of air-drying for the garment may be improved.

Hanger 600 may further include a device 640 that may be substantially analogous to device 630 and may substantially mirror device 630.

Figure 7:
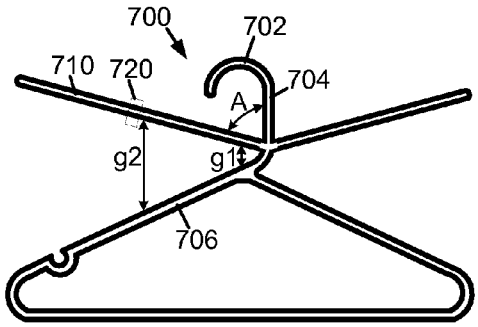
FIG. 7 shows a schematic representation illustrating a view (e.g., a front view) of a hanger in accordance with one or more embodiments of the present invention.

FIG. 7 shows a schematic representation illustrating a view (e.g., a front view) of a hanger 700 in accordance with one or more embodiments of the present invention. One or more features of hanger 700 may be identical to, equivalent to, corresponding to, or analogous to one or more features of one or more of hangers 100, 200, 300, 400, 500, and 600 discussed with reference to the examples of FIGS. 1-6.

In hanger 700, branch 710 (which is disposed between hook 702 and branch 706) may form an angle A with medium 704, wherein angle A may be between branch 710 and hook 702 and may be less than 90 degrees. Accordingly, branch 710 may point (or extend) upward when branch 706 points (or extends) downward, e.g., when hanger 700 is hung on a rod. The upward orientation of branch 710 may facilitate retention of a garment item that is disposed on branch 710.

In one or more embodiments, branch 706 may extend downward for accommodating a shoulder portion of a garment, while the third branch may extend upward for retaining a sock. In one or more embodiments, a distance between branch 710 and branch 706 may substantially monotonically decrease from a position 720 corresponding to a middle of branch 710 to medium 704. For example, a gap g1 between branch 720 and 706 may be closer to medium 704 than a gap g2 between branch 720 and 706, and gap g1 may be smaller than gap g2.

Figure 8B:
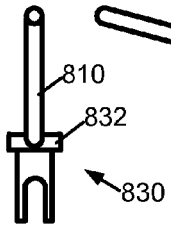
FIG. 8B shows a schematic representation illustrating a view (e.g., a side view) of a device for enhancing use of a hanger in accordance with one or more embodiments of the present invention.
Figure 8A:
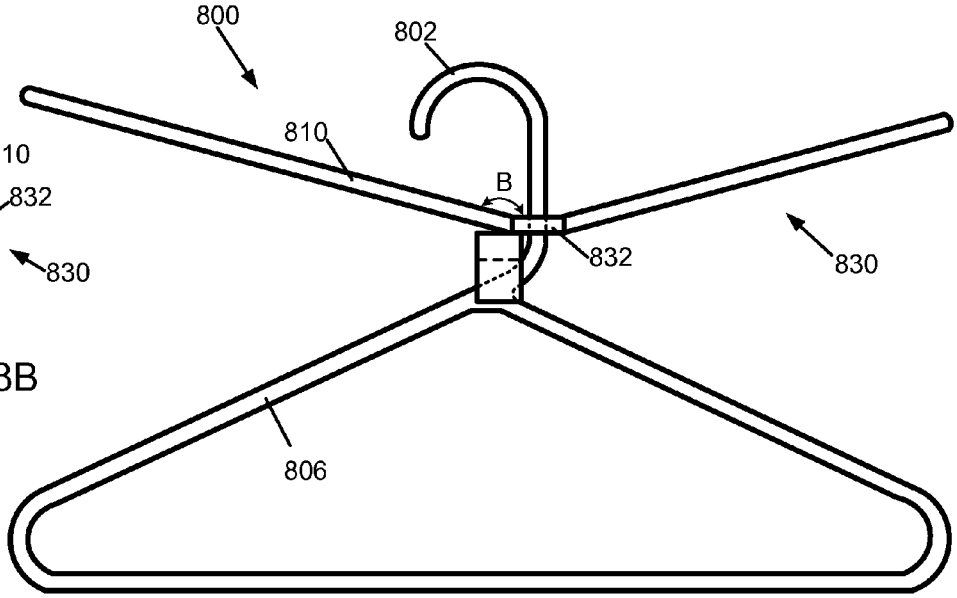
FIG. 8A shows a schematic representation illustrating a view (e.g., a front view) of a hanger in accordance with one or more embodiments of the present invention.
Figure 8C:
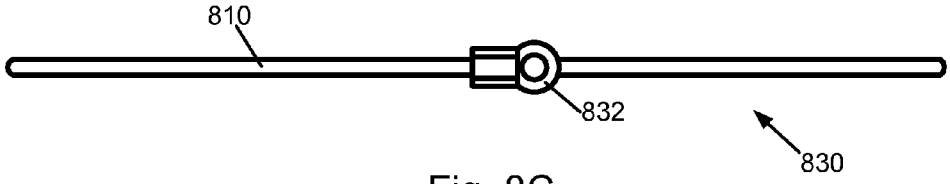
FIG. 8C shows a schematic representation illustrating a view (e.g., a bottom view) of a device for enhancing use of a hanger in accordance with one or more embodiments of the present invention.

FIG. 8A shows a schematic representation illustrating a view (e.g., a front view) of a hanger 800 that includes a device 830 for enhancing use of hanger 800 in accordance with one or more embodiments of the present invention. FIG. 8B shows a schematic representation illustrating a view (e.g., a side view) of device 830 in accordance with one or more embodiments of the present invention. FIG. 8C shows a schematic representation illustrating a view (e.g., a bottom view) of device 830 in accordance with one or more embodiments of the present invention. One or more features of hanger 800 may be identical to, equivalent to, corresponding to, or analogous to one or more features of one or more of hangers 100, 200, 300, 400, 500, 600, and 700 discussed with reference to the examples of FIGS. 1-7. One or more features of device 830 may be identical to, equivalent to, corresponding to, or analogous to one or more features of devices 330, 380, 430, 540, 530, and 630 discussed with reference to the examples of FIGS. 3A-6.

In hanger 800 (and device 830), branch 810 (disposed between hook 802 and branch 806) may be disposed at an angle B with respect to a top surface of hollow portion 832, wherein angle B may be greater than 90 degrees and less than 180 degrees. The configuration may correspond to an upward orientation of branch 810, for effectively retain a garment item.

Figure 9:
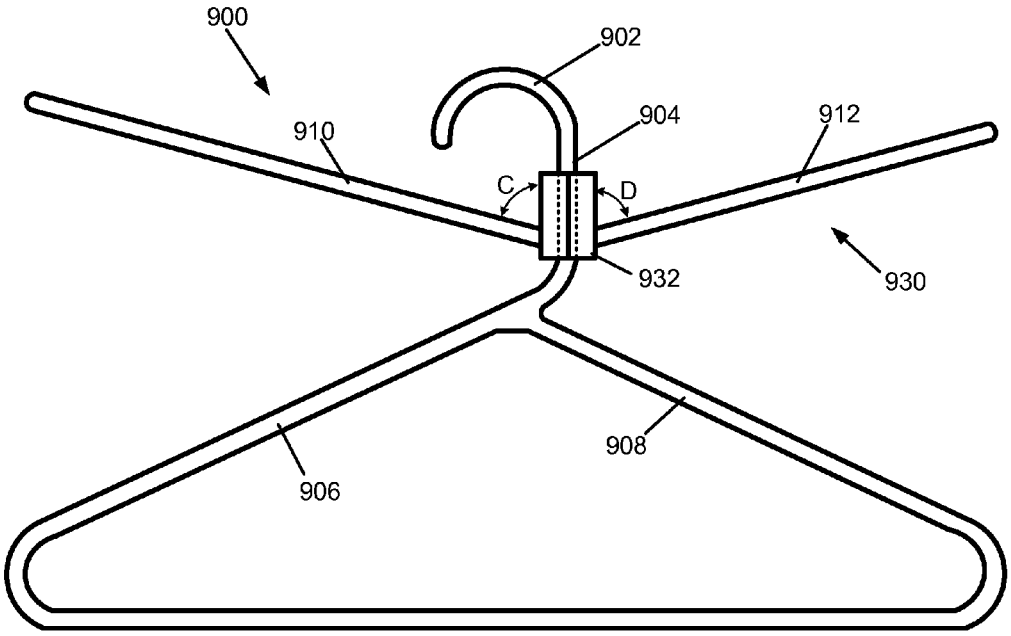
FIG. 9 shows a schematic representation illustrating a view (e.g., a front view) of a hanger in accordance with one or more embodiments of the present invention.

FIG. 9 shows a schematic representation illustrating a view (e.g., a front view) of a hanger 900 that includes a device 930 for enhancing use of hanger 900 in accordance with one or more embodiments of the present invention. One or more features of hanger 900 may be identical to, equivalent to, corresponding to, or analogous to one or more features of one or more of hangers 100, 200, 300, 400, 500, 600, 700, and 900 discussed with reference to the examples of FIGS. 1-8C. One or more features of device 930 may be identical to, equivalent to, corresponding to, or analogous to one or more features of devices 330, 380, 430, 540, 530, 630, and 830 discussed with reference to the examples of FIGS. 3A-8C.

In hanger 900 (and device 930), branch 910 (which is disposed between hook 902 and branch 906) may form an angle C with (the extension direction of or a sidewall of) hollow portion 932, wherein angle C may be between branch 910 and hook 902 and may be less than 90 degrees. Branch 910 may point (or extend) upward when branch 906 points (or extends) downward, e.g., when hanger 900 is hung on a rod. The upward orientation of branch 910 may facilitate retention of a garment item that is disposed on branch 910.

Hollow portion 932 may be disposed between branch 910 and branch 912. Branch 912 may form an angle D with (the extension direction of or a sidewall of) hollow portion 932, wherein hollow portion 932 may be between angle C and angle D, and wherein angle D may be less than 90 degrees. Branch 912 may point (or extend) upward when branch 908 points (or extends) downward, e.g., when hanger 900 is hung on a rod. The upward orientation of branch 912 may facilitate retention of a garment item that is disposed on branch 912.

Figure 10:
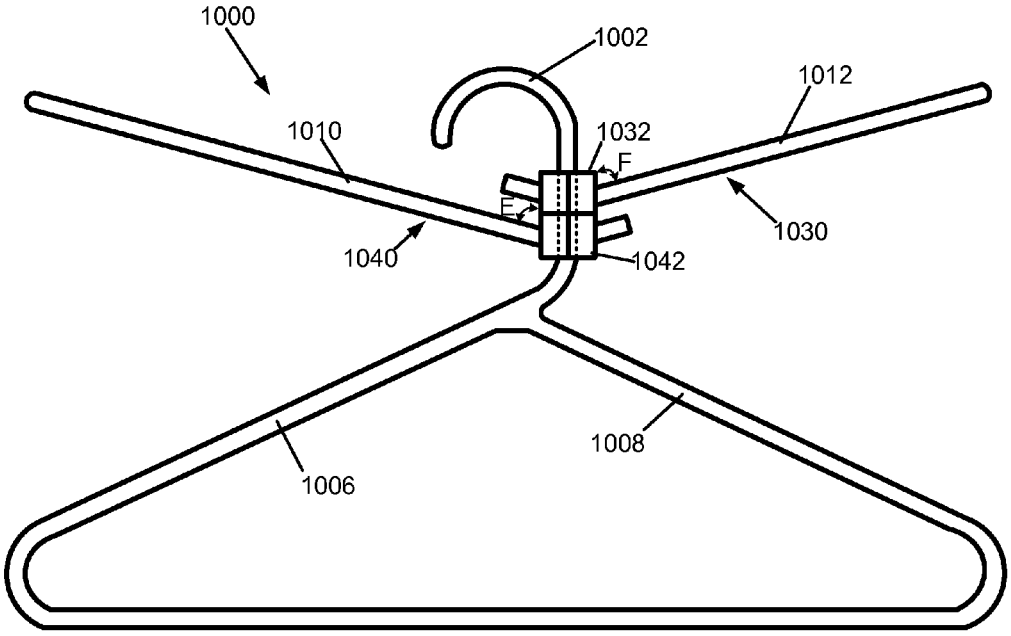
FIG. 10 shows a schematic representation illustrating a view (e.g., a front view) of a hanger in accordance with one or more embodiments of the present invention.

FIG. 10 shows a schematic representation illustrating a view (e.g., a front view) of a hanger 1000 that includes a device 1040 and a device 1030 for enhancing use of hanger 1000 in accordance with one or more embodiments of the present invention. One or more features of hanger 1000 may be identical to, equivalent to, corresponding to, or analogous to one or more features of one or more of hangers 100, 200, 300, 400, 500, 600, 700, 800, and 900 discussed with reference to the examples of FIGS. 1-9. One or more features of device 1040 and device 1030 may be identical to, equivalent to, corresponding to, or analogous to one or more features of devices 330, 380, 430, 540, 530, 630, 830, and 930 discussed with reference to the examples of FIGS. 3A-9.

In hanger 1000 (and device 1040 and/or device 1030), branch 1010 may form an angle E with (the extension direction of or a sidewall of) at least one of hollow portion 1042 and 1032, wherein angle D may be between branch 1010 and hook 1002 and may be less than 90 degrees. Branch 1010 may point (or extend) upward when branch 1006 points (or extends) downward, e.g., when hanger 1000 is hung on a rod. The upward orientation of branch 1010 may facilitate retention of a garment item that is disposed on branch 1010.

At least one of hollow portion 1032 and hollow portion 1042 may be disposed between branch 1010 and branch 1012. Branch 1012 may form an angle F with (the extension direction of or a sidewall of) with at least one of hollow portion 1032 and hollow portion 1042, wherein hollow at least one of hollow portion 1032 and hollow portion 1042 may be between angle E and angle F, and wherein angle F may be less than 90 degrees. Branch 1012 may point (or extend) upward when branch 1008 points (or extends) downward, e.g., when hanger 1000 is hung on a rod. The upward orientation of branch 1012 may facilitate retention of a garment item that is disposed on branch 1012.

Figure 11:
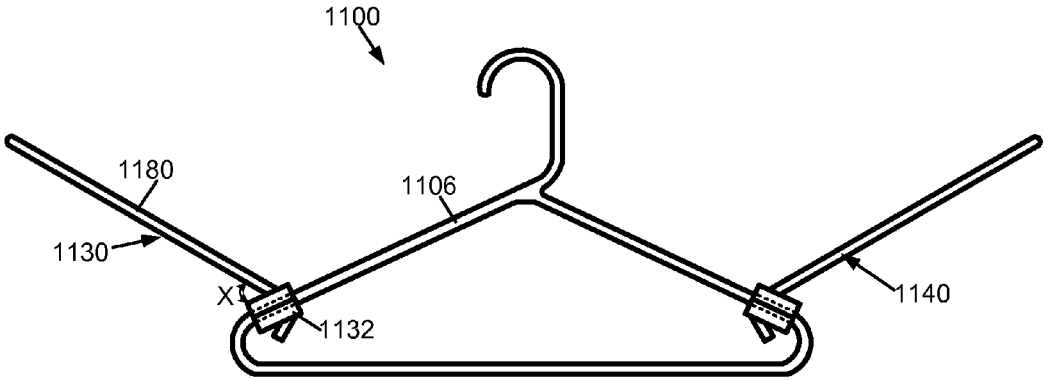
FIG. 11 shows a schematic representation illustrating a view (e.g., a front view) of a hanger in accordance with one or more embodiments of the present invention.

FIG. 11 shows a schematic representation illustrating a view (e.g., a front view) of a hanger 1100 that includes a device 1130 and a device 1140 for enhancing use of hanger 1100 in accordance with one or more embodiments of the present invention. One or more features of hanger 1100 may be identical to, equivalent to, corresponding to, or analogous to one or more features of one or more of hangers 100, 200, 300, 400, 500, 600, 700, 800, 900, and 1000 discussed with reference to the examples of FIGS. 1-10. One or more features of device 1130 and device 1140 may be identical to, equivalent to, corresponding to, or analogous to one or more features of devices 330, 380, 430, 540, 530, 630, 830, 930, 1040, and 1030 discussed with reference to the examples of FIGS. 3A-10.

Hanger 1100 may include a branch 1106 and device 1130. Branch 1106 may be configured to support a shoulder portion of the garment. Device 1130 may include a hollow portion 1132 (e.g., a ring) coupled with branch 1106 and surrounding a portion of branch 1106. Device 1130 may further include a branch 1180 connected through hollow portion 1132 to branch 1106. Branch 1180 may be disposed at an angle X with respect to hollow portion 1132. Branch 1180 may reduce an overlap between parts of the garment, e.g., an overlap between a sleeve and a body portion of a shirt. Advantageously, efficiency of air-drying for the garment may be improved.

Hanger 1100 may further include a device 1140 that may be substantially analogous to device 1130 and may substantially mirror device 1130.

Disposing a garment part (e.g., a sleeve) on branch 1180 may be relatively easier than disposing the garment part on branch 630 that is discussed with reference to FIG. 6, while hanger 600 discussed with reference to FIG. 6 may have a smaller footprint than hanger 1100.

Figure 12:
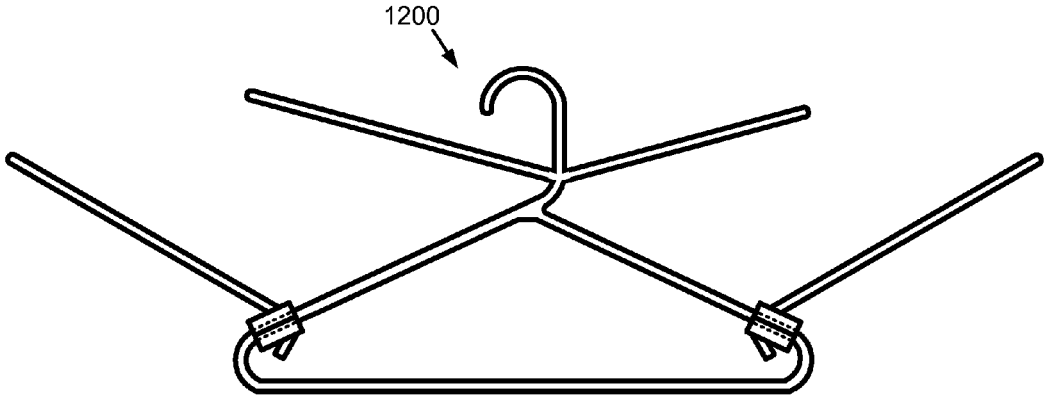
FIG. 12 shows a schematic representation illustrating a view (e.g., a front view) of a hanger in accordance with one or more embodiments of the present invention.

FIG. 12 shows a schematic representation illustrating a view (e.g., a front view) of a hanger 1200 that includes devices for enhancing use of hanger 1200 in accordance with one or more embodiments of the present invention. One or more features of hanger 1200 may be identical to, equivalent to, corresponding to, or analogous to one or more features of one or more of hangers 100, 200, 300, 400, 500, 600, 700, 800, 900, 1000, and 1100 discussed with reference to the examples of FIGS. 1-11. One or more features of may be identical to, equivalent to, corresponding to, or analogous to one or more features of devices 330, 380, 430, 540, 530, 630, 830, 930, 1040, 1030, 1130, and 1140 discussed with reference to the examples of FIGS. 3A-11. In particular, hanger 1200 may include features of hanger 700 discussed with reference to FIG. 7 and hanger 1100 discussed with reference to FIG. 11.

Figure 13:
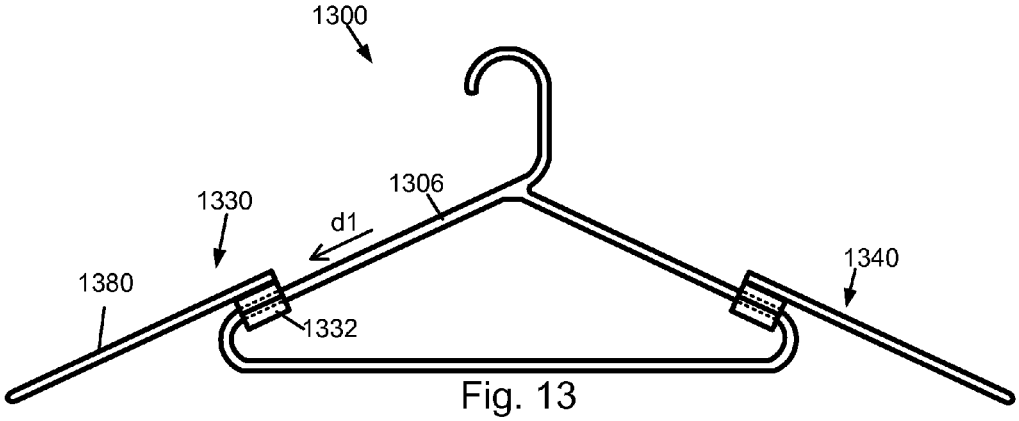
FIG. 13 shows a schematic representation illustrating a view (e.g., a front view) of a hanger in accordance with one or more embodiments of the present invention.

FIG. 13 shows a schematic representation illustrating a view (e.g., a front view) of a hanger 1300 that includes a device 1330 and a device 1340 for enhancing use of hanger 1300 in accordance with one or more embodiments of the present invention. One or more features of hanger 1300 may be identical to, equivalent to, corresponding to, or analogous to one or more features of one or more of hangers 100, 200, 300, 400, 500, 600, 700, 800, 900, 1000, 1100, and 1200 discussed with reference to the examples of FIGS. 1-12. One or more features of device 1330 and device 1340 may be identical to, equivalent to, corresponding to, or analogous to one or more features of devices 330, 380, 430, 540, 530, 630, 830, 930, 1040, 1030, 1130, and 1140 discussed with reference to the examples of FIGS. 3A-11.

Hanger 1300 may include a branch 1306 and device 1330. Branch 1306 may be configured to support a shoulder portion of the garment. Device 1330 may include a hollow portion 1332 (e.g., a ring) coupled with branch 1306 and surrounding a portion of branch 1306. Device 1330 may further include a branch 1380 connected through hollow portion 1332 to branch 1306. Branch 1380 may be substantially parallel to hollow portion 1332. Both branch 1380 and branch 1306 may extend in direction d1 such that branch 1380 may be substantially parallel to (or substantially aligned with) branch 1306. Branch 1380 may reduce an overlap between parts of the garment, e.g., an overlap between a sleeve and a body portion of a shirt. Advantageously, efficiency of air-drying for the garment may be improved.

Hanger 1300 may further include a device 1340 that may be substantially analogous to device 1330 and may substantially mirror device 1330.

Hanger 1300 may be especially useful for air-drying trousers and pants, in addition to other garment items. Device 1330 and device 1340 may significantly reduce an overlap between parts of the garment, e.g., an overlap between trouser legs. Advantageously, efficiency of air-drying for the garment may be improved.

While this invention has been described in terms of several embodiments, there are alterations, permutations, and equivalents, which fall within the scope of this invention. It should also be noted that there are many alternative ways of implementing the methods and apparatuses of the present invention. Furthermore, embodiments of the present invention may find utility in other applications. The abstract section may be provided herein for convenience and, due to word count limitation, may be accordingly written for reading convenience and should not be employed to limit the scope of the claims. It may be therefore intended that the following appended claims be interpreted as including all such alterations, permutations, and equivalents as fall within the true spirit and scope of the present invention.

What is claimed is:

1. A hanger for supporting at least a garment, the hanger comprising:

a hook;

a medium connected to the hook;

a first branch, the first branch being connected through the medium to the hook and being oriented according to a first direction;

a second branch, the second branch being connected through the medium to the hook and being oriented according to a second direction;

a third branch, the third branch being disposed between the first branch and the hook, being connected to the medium, and being oriented according to a third direction, the third direction being different from the first direction; and a fourth branch, the four branch being connected to the medium and being oriented according to a fourth direction, the fourth direction being different from the second direction, wherein the medium is disposed between the third branch and the fourth branch, and wherein the third branch is asymmetric to the fourth branch with reference to the medium.

2. The hanger of claim 1, wherein the shape of the third branch is substantially different from the shape of the first branch.

3. The hanger of claim 1, wherein the third branch is horizontal or points upward when the first branch points downward.

4. The hanger of claim 1, wherein the third branch is not thicker than the first branch.

5. The hanger of claim 1, wherein a gap between the third branch and the hook is less than or equal to 1.625 inches.

6. The hanger of claim 1, wherein the third branch is coplanar with both the first branch and the hook.

7. The hanger of claim 1, wherein a length of the third branch is substantially equal to a sum of a length of the fourth branch and a width of the hook.

8. The hanger of claim 1, wherein the hanger comprises a closed-loop structure that includes the first branch and the second branch and is coplanar with each of the hook, the third branch, and the fourth branch.

9. The hanger of claim 1, wherein the third branch forms a first angle with the medium, the first angle being between the third branch and the hook and being less than 90 degrees.

10. The hanger of claim 1, wherein a distance between the third branch and the first branch substantially monotonically decreases from a position corresponding to a middle of the third branch to the medium.

11. A hanger for supporting at least a garment, the hanger comprising:

a hook;

a medium connected to the hook;

a first branch, the first branch being connected through the medium to the hook and being oriented according to a first direction;

a second branch, the second branch being connected through the medium to the hook and being oriented according to a second direction;

a third branch, the third branch being connected to the medium and being oriented according to a third direction, the third direction being different from the first direction;

a fourth branch, the four branch being connected to the medium and being oriented according to a fourth direction, the fourth direction being different from the second direction, wherein the medium is disposed between the third branch and the fourth branch;

a first hollow portion surrounding the medium, the first hollow portion being connected to the third branch; and a stopper connected to at least one of the first hollow portion, the third branch, and the fourth branch, the stopper having a recess, wherein at least one of a portion of the first branch and a portion of the second branch is disposed inside the recess.

12. The hanger of claim 11, wherein the third branch is disposed between the first branch and the hook.

13. The hanger of claim 11, wherein the first hollow portion is disposed between the third branch and the fourth branch.

14. A hanger for supporting at least a garment, the hanger comprising:

a hook;

a medium connected to the hook;

a first branch, the first branch being connected through the medium to the hook and being oriented according to a first direction;

a second branch, the second branch being connected through the medium to the hook and being oriented according to a second direction;

a third branch, the third branch being connected to the medium and being oriented according to a third direction, the third direction being different from the first direction;

a fourth branch, the four branch being connected to the medium and being oriented according to a fourth direction, the fourth direction being different from the second direction, wherein the medium is disposed between the third branch and the fourth branch;

a hollow portion surrounding the medium, the first hollow portion being connected to the third branch, wherein the hollow portion has a through hole and a gap for receiving the medium into the through hole, the gap being not substantially aligned with the third branch.

15. The hanger of claim 11, wherein the first hollow portion has a through hole and a gap for receiving the medium into the through hole, and wherein the gap has a tapered structure.

16. The hanger of claim 11, wherein the third branch is disposed at a second angle with respect to a top surface of the first hollow portion, the second angle being greater than 90 degrees and less than 180 degrees.

17. The hanger of claim 11, wherein a length of the first hollow portion is larger than or equal to a thickness of the medium.

18. The hanger of claim 11, further comprising: a second hollow portion surrounding the medium, the second hollow portion overlapping the first hollow portion and being connected to the fourth branch, wherein the third branch is connected through the first hollow portion and the second hollow portion to the fourth branch.

19. The hanger of claim 1, further comprising:

a hollow portion surrounding the first branch; and a fifth branch connected through the hollow portion to the first branch.

20. A device for enhancing use of a hanger, the hanger including a hook and a branch connected to the hook, the hanger being configured for supporting a garment, the device comprising:

a hollow portion having a through hole, the through hole being configured for receiving a portion of the hanger;

an elongated portion connected to the hollow portion; and a stopper connected to at least one of the hollow portion and the elongated portion, the stopper having a recess for receiving a portion of the branch.

* * * * *